US007708143B2

(12) United States Patent
Adams

(10) Patent No.: US 7,708,143 B2
(45) Date of Patent: May 4, 2010

(54) FOOD AND BEVERAGE CONTAINER

(75) Inventor: Sharon Sams Adams, Trophy Club, TX (US)

(73) Assignee: Arlington Services, Inc., Wilmington, DE (US)

( * ) Notice: Subject to any disclaimer, the term of this patent is extended or adjusted under 35 U.S.C. 154(b) by 334 days.

(21) Appl. No.: 11/820,535

(22) Filed: Jun. 20, 2007

(65) Prior Publication Data

US 2008/0314788 A1 Dec. 25, 2008

(51) Int. Cl.
*A45C 11/20* (2006.01)

(52) U.S. Cl. ..... 206/549; 206/541; 229/117.15; 229/124; 229/141

(58) Field of Classification Search ..... 206/549, 206/541, 155, 168, 194, 427; 220/770, 768, 220/767, 754, 752, 836, 726, 810, 324, 315; 229/117.15, 904, 124, 131.1, 141, 117.19, 229/117.23, 117.24
See application file for complete search history.

(56) References Cited

U.S. PATENT DOCUMENTS 1,202,422 A * 10/1916 Porter ..... 206/45.29
1,937,643 A * 12/1933 Drewry ..... 229/117.15
3,326,445 A * 6/1967 Goings ..... 206/563
4,088,262 A * 5/1978 Kuehlhorn ..... 206/486
4,171,763 A * 10/1979 Card ..... 229/117.15
4,176,423 A * 12/1979 Wigemark ..... 16/406
4,572,423 A * 2/1986 Spencer ..... 206/562
4,705,173 A * 11/1987 Forbes, Jr. ..... 206/563
4,708,248 A 11/1987 Davis
4,946,094 A * 8/1990 Stang ..... 224/270
5,860,555 A * 1/1999 Mayled ..... 220/62
6,045,037 A * 4/2000 McGeehin ..... 229/125.39
6,183,027 B1 2/2001 Tsao
6,213,389 B1 * 4/2001 Cai ..... 229/120.08
6,401,927 B1 6/2002 Sorensen et al.
6,527,123 B1 * 3/2003 Ausaf ..... 206/549
6,540,133 B1 * 4/2003 Chou ..... 229/117.22
6,851,276 B2 2/2005 Perrins
6,932,214 B1 * 8/2005 Zimet ..... 206/217
7,441,693 B2 * 10/2008 Liao ..... 229/117.19
2006/0202005 A1 * 9/2006 Andrews et al. ..... 229/117.3
2006/0237519 A1 * 10/2006 Hui ..... 229/117.08
2007/0257092 A1 * 11/2007 Bezar ..... 229/87.19

FOREIGN PATENT DOCUMENTS

GB 2013162 A * 8/1979

* cited by examiner

*Primary Examiner*—David T Fidei
(74) *Attorney, Agent, or Firm*—Gardere Wynne Sewell LLP

(57) ABSTRACT

A container suitable for storage of food and drink items is disclosed that allows for a quick visual check of whether the container has been properly and completely packed. The container also can be easily and inexpensively constructed from a single sheet of fiberboard. The container includes a base, wall sections, and a lid that is hingedly connected to one of the wall sections. The lid can include a handle and an aperture that allows the top of a drink bottle to extend out of the container. This provides a way to quickly verify the contents of the container.

8 Claims, 5 Drawing Sheets

FOOD AND BEVERAGE CONTAINER

TECHNICAL FIELD

This invention relates to containers and more particularly to container means designed for use in conjunction with the carrying of foods and/or beverages.

BACKGROUND

There are a number of know food and beverage containers in the art. For example, food containers such as "lunch boxes" are available are commonly available in a box or bag shape. Some are formed of insulating materials for helping to keep the contents hot or cold, but such materials are expensive and not useful for single-use applications. Styrofoam and cardboard containers are commonly used for food storage, but do not provide good storage for both a bottled drink and a food item. Also, such prior food containers do not provide for a quick and easy way to check the contents without opening the container. In situations where large numbers of food containers are being packed, it can be very time consumer to open each container for inspection to determine whether the container includes all of the required contents.

SUMMARY

Disclosed herein is a container suitable for storage of food and drink items, or the like. The disclosed container allows for a quick visual check of whether the container has been properly and completely packed. This provides a benefit for business or individuals that need to prepare large numbers of meals packaged in disposable food containers and would like a way to quickly verify the contents of numerous food containers. Prior disposable containers must be opened in order to check for proper contents. The disclosed container, on the other hand, allows for a portion of a stored item, for example the top of a drink bottle, to partially extend from the container so that its presence can be quickly and easily verified. This also allows a consumer the ability to easily see the type of drink packed in the container.

BRIEF DESCRIPTION OF THE DRAWINGS

Embodiments are illustrated by way of example in the accompanying figures, in which like reference numbers indicate similar parts, and in which.

DETAILED DESCRIPTION

Figure 1:
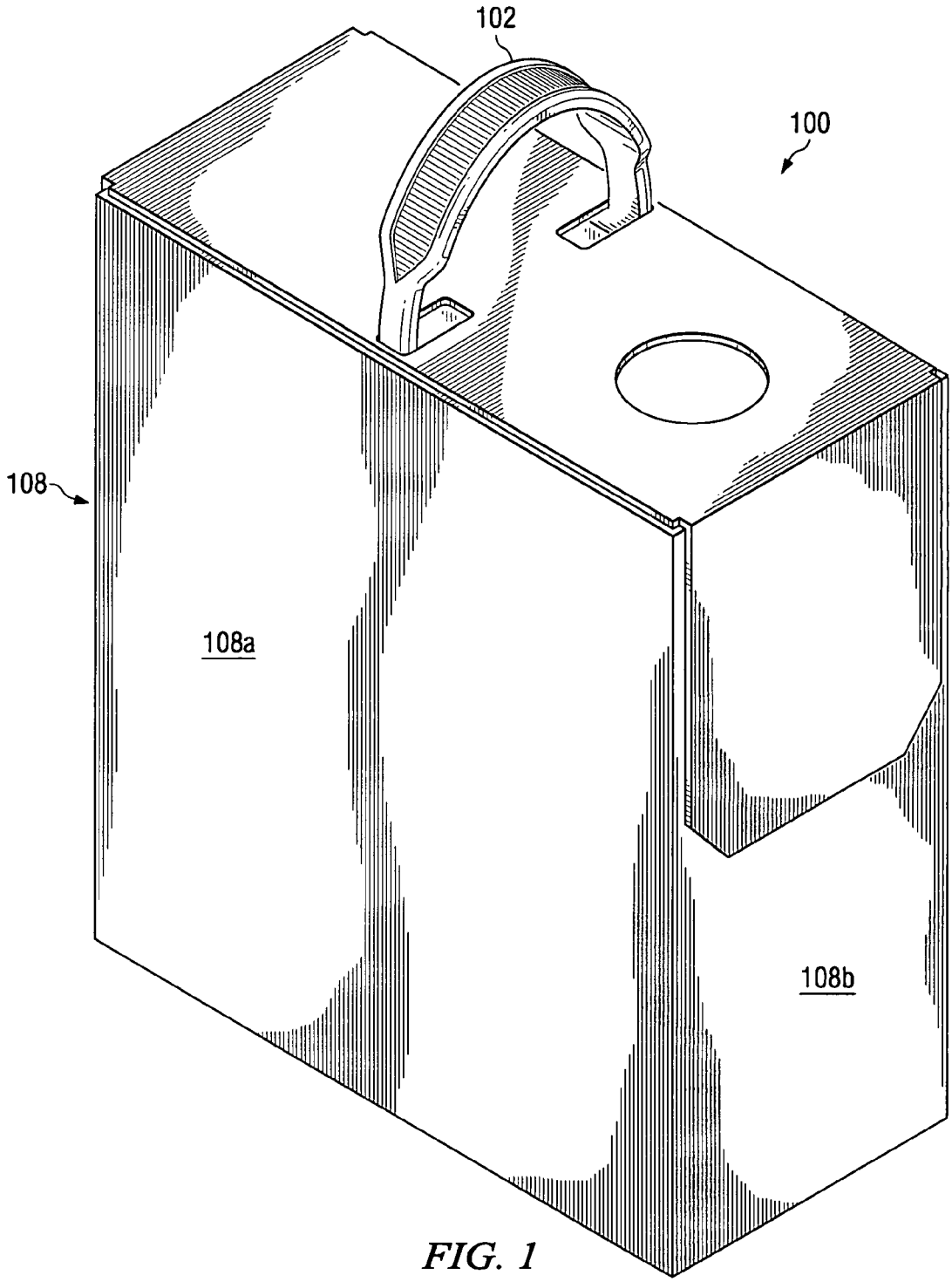
FIGS. 1-3 show perspective views of a container suitable for storage of food and drink items.
Figure 2:
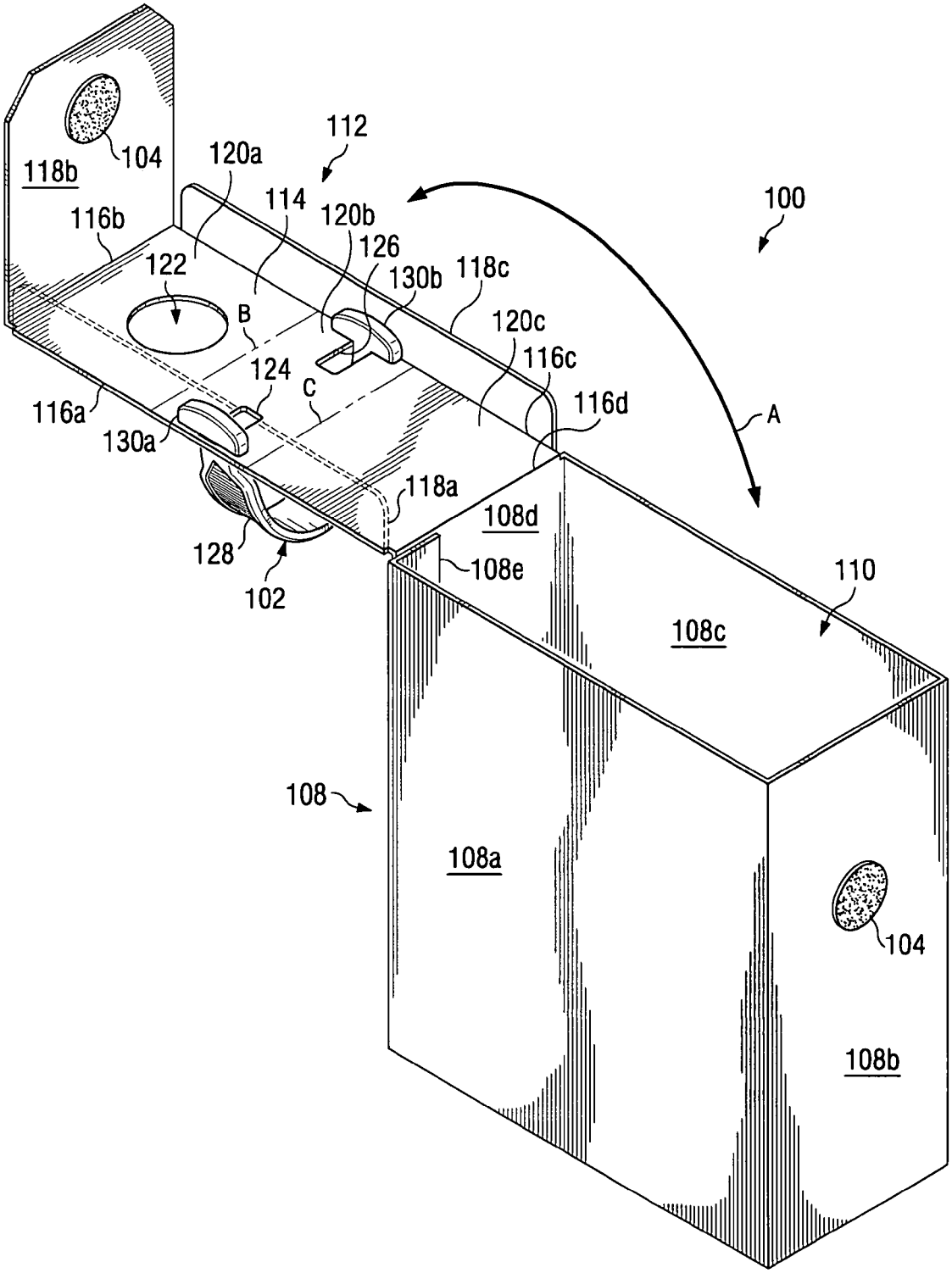
Figure 3:
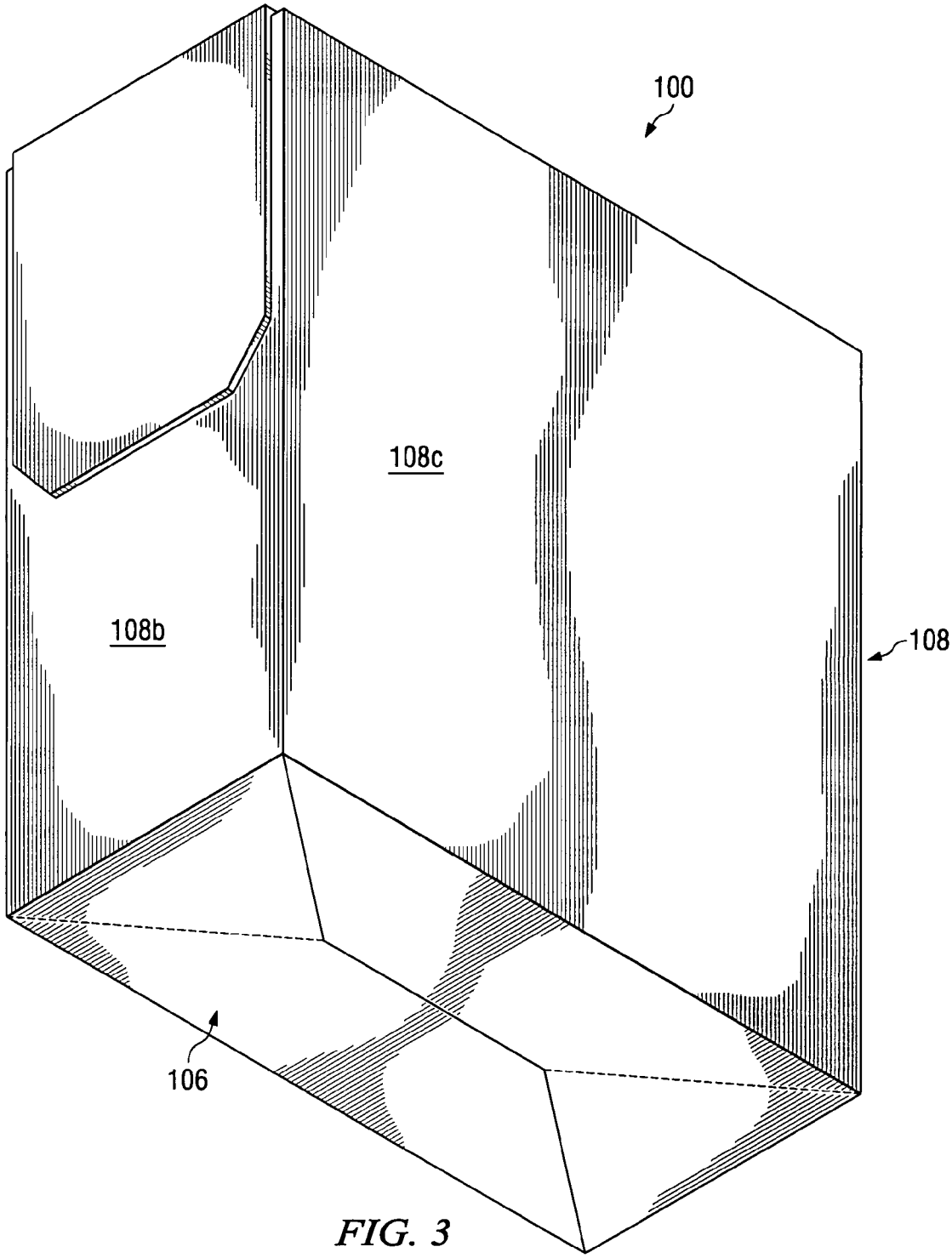

FIGS. 1-3 show perspective views of a container 100 suitable for storage of food and drink items, or the like. FIGS. 1 and 2 show top perspective views of the container 100, where the container 100 is shown closed in FIG. 1 and open in FIG. 2. FIG. 3 shows a bottom perspective view of the closed container 100. The container 100 provides a compact, inexpensive article for storing food and drink items. For example, in some embodiments, most of the container 100 (e.g., excluding such things as the handle 102 and the fastener 104) can be formed from a blank that is cut from a sheet of corrugated fiberboard, plastic, or other material.

An embodiment of the container 100 will now be described with reference to FIGS. 1-3. The container 100 includes a base 106, preferably formed of a rigid or substantially rigid material. During normal use of the container 100, e.g., when the container 100 is carried by the handle 102, the base 106 will be the bottom of the container 100 and serve as the primary support for items stored in the container 100. For this reason, in some embodiments the base 106 can include reinforcement for added strength. For example, in embodiments where the container 100 is formed from a sheet of corrugated fiberboard having a substantially uniform thickness, the base 106 can include a single layer of the corrugated fiberboard, or for added strength the base 106 can include multiple layers of the corrugated fiberboard.

Next, with reference to the container being positioned as shown in FIGS. 1 and 2 so that the base 106 is on the bottom, a peripheral wall 108 extends upward from around a periphery of the base 106. The peripheral wall 108 is preferably formed of a rigid or substantially rigid material. The peripheral wall 108 comprises a plurality of wall sections 108*a*, 108*b*, 108*c*, and 108*d*. The peripheral wall 108, in combination with the base 106, defines the sides and bottom of a chamber 110 in which items can be stored. In some embodiments, the peripheral wall 108 is formed of corrugated fiberboard that is folded along the intersections between adjacent wall sections 108*a*-108*d*, and also along the intersection between the peripheral wall 108 and the base 106. In some embodiments, the peripheral wall 108 can be provided with decorative or promotional indicia, including advertisements, providing for a source of revenue for business that may be providing containers 100 to consumers.

Also, in some embodiments, the peripheral wall 108 can include one or more flanges 108*e*. In the illustrated embodiment, the wall sections 108*a*-108*d* are formed from a continuous sheet of material that is folded between wall sections 108*a* and 108*b*, between wall sections 108*b* and 108*c*, and between wall sections 108*c* and 108*d*. At the intersection between wall sections 108*a* and 108*d*, the flange 108*e* is used to join the two wall sections 108*a* and 108*d*. The flange 108*e* is a continuation of the material used to form the wall section 108*a*, where a fold has been made along the intersection between the wall section 108*a* and the flange 108*e*. The flange 108*e* is fixed to the wall section 108*d*, for example using adhesive and/or mechanical fasteners, such as a staples or the like. In alternative embodiments, the wall sections 108*a* and 108*d* can be formed of any number of separate sheets of material, and joined together using any attachment method.

The container also includes a lid 112 that can be moved by a consumer between the closed position illustrated in FIG. 1 and the open position illustrated in FIG. 2 in the general directions indicated by the arrow A shown in FIG. 2. The lid 112 is preferably formed of a rigid or substantially rigid material. The lid 112 comprises a lid panel 114, a plurality of lid edges 116*a*-116*d*, and a plurality of lid flaps 118*a*-118*c*. The lid flap 118*a* is not shown in order to allow for a clear view of other elements of the lid 112; however, the outline of the lid flap 118*a* is shown with broken lines. The lid flap 118*a* is hingedly connected to the lid panel 114 along the lid edge 116*a*, the lid flap 118*b* is hingedly connected to the lid panel 114 along the lid edge 116*b*, and the lid flap 118*c* is hingedly connected, opposite the flap 118*a*, to the lid panel 114 along the lid edge 116*c*. The lid panel 114 is hingedly connected, opposite the lid flap 118*b*, to the wall section 108*d* along the lid edge 116*d*. In some embodiments, the lid 112, including lid flaps 118*a*-118*c*, is formed of corrugated fiberboard, which is folded along lid edge 116*a* to form the lid flap 118*a*, along lid edge 116*b* to form the lid flap 118*b*, and along lid edge 116*c* to form the lid flap 118*c*. In some embodiments, including the illustrated embodiment, the lid 112 and at least the wall section 108*d* are formed from a continuous sheet of material, which is folded to form the lid edge 116*d* along the intersection between the lid panel 114 and the wall section 108*d*.

The lid flaps 118*a* and 118*c* can provide added strength to help the lid panel 114 resist buckling when the container 100 is carried by the handle 102. In order for the lid flaps 118*a* and 118*c* to be most effective, the lid flaps 118*a* and 118*c* should be folded approximately 90 degrees from the plane of the lid panel 114 as shown in FIG. 2. When the lid is closed (FIG. 1), the lid flap 118*a* is positioned on the inner side of the wall section 108*a*, and the lid flap 118*c* is positioned on the inner side of the wall section 108*c*. Thus, the width of the lid panel 114 (distance between lid edge 116*a* and lid edge 116*c*) is preferably less than the width of the chamber 110 as measured between the inner sides of the wall sections 108*a* and 108*c*.

As shown in FIG. 1, the lid flap 118*b* extends over the outside of the wall section 108*b* when the container 100 is closed. A fastener 104 is operable by the consumer to selectively fasten the lid flap 118*b* to the wall section 108*b*. There are a number of different types of conventional fastening devices that can be used as the fastener 104, for example, hook and loop fasteners, such as Velcro®, buttons, or snaps. In a preferred embodiment, adhesive-backed hook and loop fasteners are used, where one of the hook and loop parts is fixed to the lid flap 118*b*, and the other mating hook and loop part is fixed to the outside of the wall section 108*b*. The fastener 104 is preferably chosen so as to not only provide a way of selectively fastening the lid flap 118*b* to the wall section 108*b*, but to also prevent the lid flap 118*b* from sliding along the wall section 108*b* while the fastener 104 is fastened. Otherwise, the lid 112 would open when the container 100 is supported by the handle 102.

The lid panel 114 includes first lid-panel region 120*a*, second lid-panel region 120*b*, and third lid-panel region 120*c*. The first lid-panel region 120*a* is bound by lid edges 116*a*, 116*b*, 116*c*, and phantom line B. The second lid-panel region 120*b* is bound by lid edge 166*a*, phantom line B, lid edge 116*c*, and phantom line C. The third lid-panel region 120*c* is bound by lid edge 116*a*, phantom line C, lid edge 116*c*, and lid edge 116*d*. The first lid-panel region includes a first lid aperture 122 that extends through the lid panel 114. The second lid-panel region 120*b* includes a second lid aperture 124 that extends through the lid panel 114 and a third lid aperture 126 that extends through the lid panel 114.

The handle 102 as shown has an optional grip region 128 that comprises a series of ridges. First and second handle-end regions 130*a* and 130*b* are provided on opposing ends of the handle 102 (i.e., opposite sides of the grip region 128). The first handle-end region 130*a* extends through the second lid aperture 124, and the second handle-end region 130*b* extends through the third lid aperture 130*b*. As shown in FIG. 2, each of the first and second handle-end regions 130 includes a narrow neck and a wider head such that the respective neck extends through the respective aperture, and the respective head is disposed on a side of the respective aperture opposite that of the grip region (i.e., on the inner side of the lid panel 114.

Figure 4:
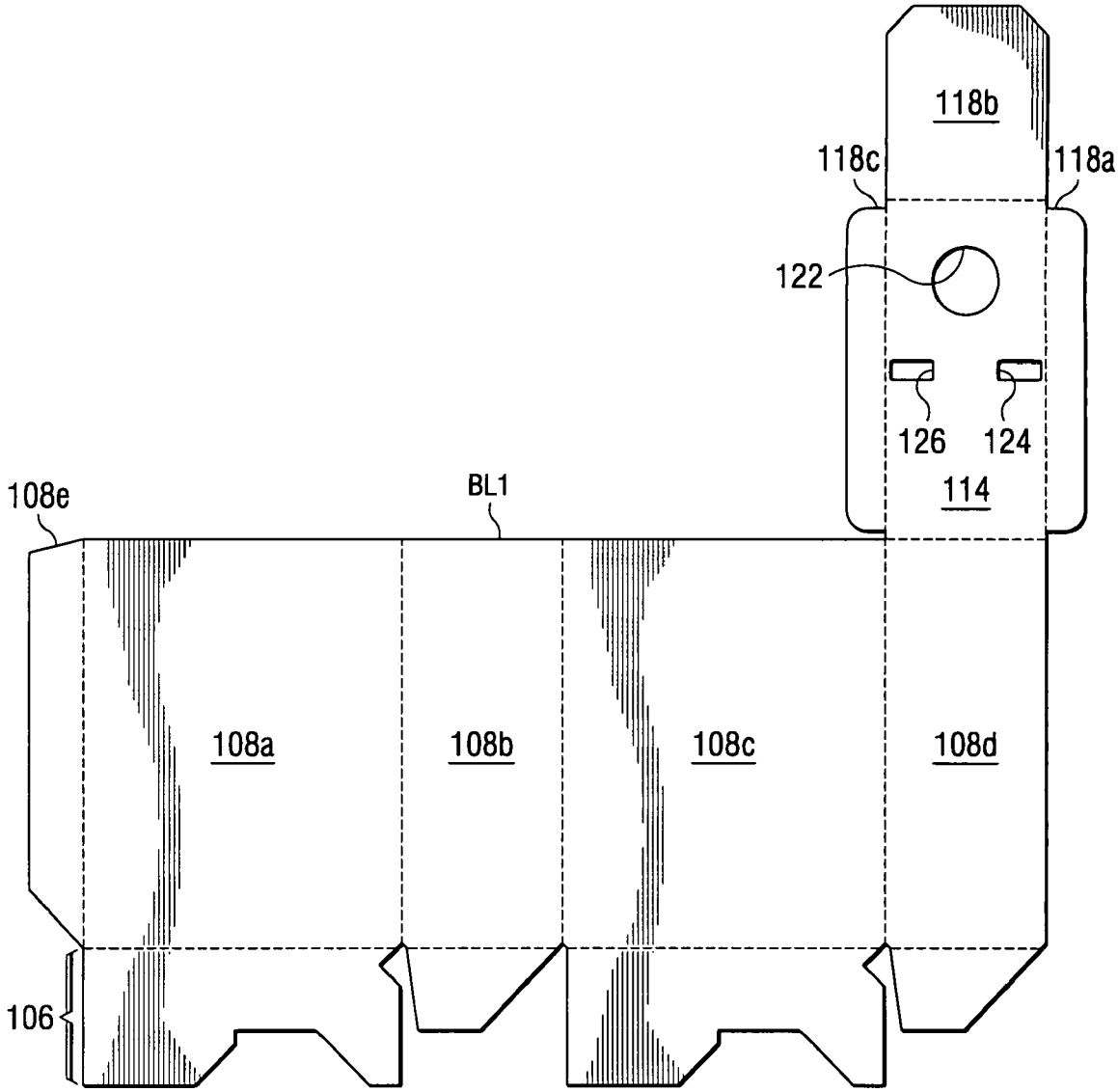
FIG. 4 shows a blank that can be used to make the container shown in FIGS. 1-3.

Note that in some embodiments, the base 106, peripheral wall 108, and lid 112 are formed from a single continuous sheet of fiberboard. For example, a blank BL1 suitable for making the container 100 is shown in FIG. 4. In FIG. 4, the solid lines represent cutting lines and the broken lines represent folding lines. Blank BL1 is preferably die cut from a respective unitary sheet of material. Examples of rigid or substantially rigid materials that can be used for the various elements of the container 100 include fiberboard, including corrugated fiberboard, plastic, Styrofoam, wood, or metal. In some embodiments, for example where wood or metal is used, various joints can include a hinge or the like in place of a fold, for example along lid edge 116*b* or along lid edge 116*d*.

Figure 5:
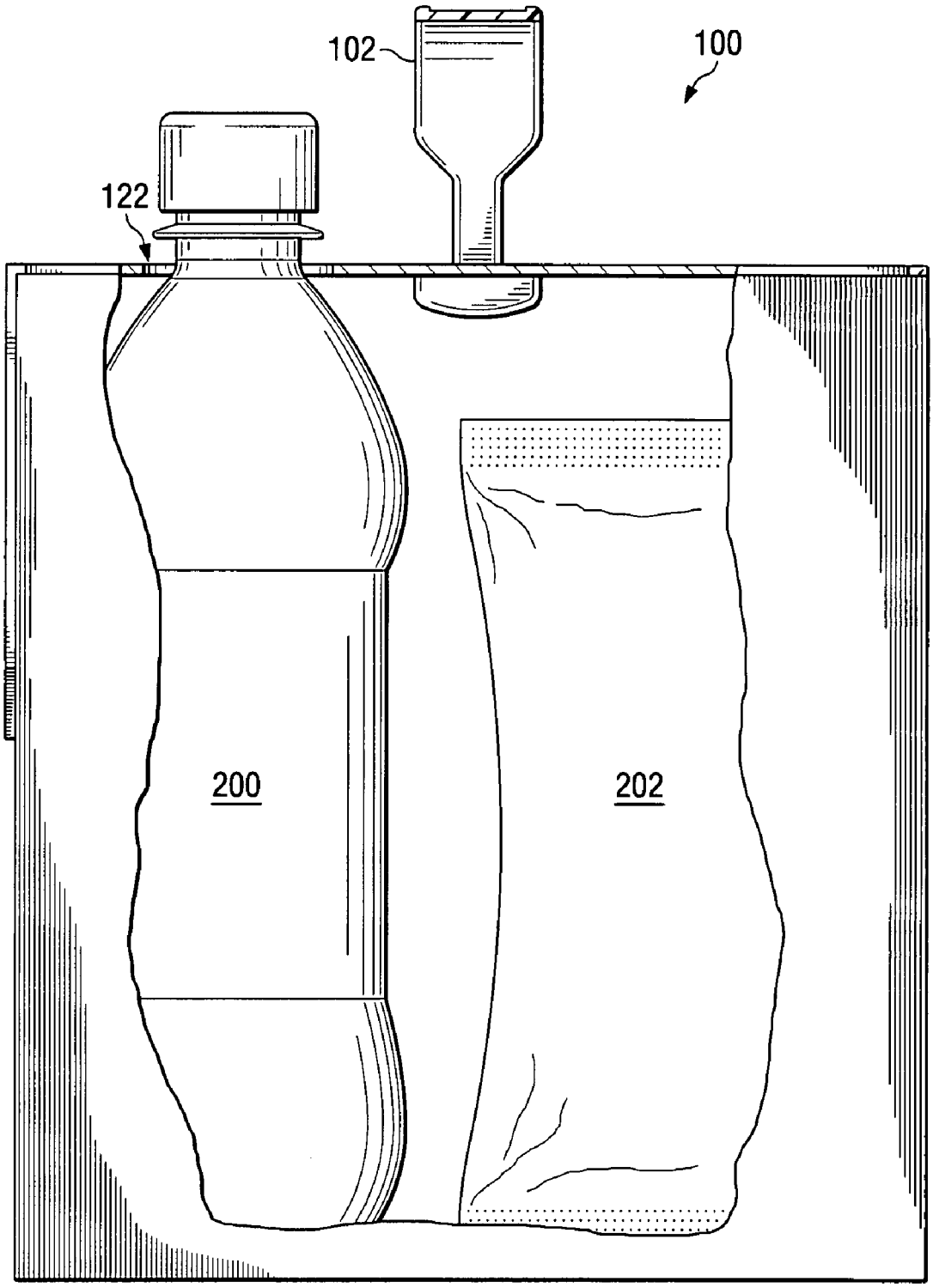
FIG. 5 shows a partially broken away view of the container shown in FIGS. 1-3.

Turning next to FIG. 5, which shows a partially broken away view of the container 100. The broken away portions of the container 100 provide a view of a drink bottle 200 and a food item 202. As shown in FIG. 5, the a first lid aperture 122 provides an opening through which the neck of a typical drink bottle 200 can extend. This is advantageous because it allows for quick inspection of the contents of the container 100 so it can easily be determined whether a drink bottle 200 has been properly packed in the container 200. Also, for a consumer presented with a large number of containers 100 that may have a variety of different types of drinks, this provides a quick and easy way to see the type of drink in each container 100 without having to open several containers.

While various embodiments in accordance with the principles disclosed herein have been described above, it should be understood that they have been presented by way of example only, and are not limiting. Thus, the breadth and scope of the invention(s) should not be limited by any of the above-described exemplary embodiments, but should be defined only in accordance with the claims and their equivalents issuing from this disclosure. Furthermore, the above advantages and features are provided in described embodiments, but shall not limit the application of such issued claims to processes and structures accomplishing any or all of the above advantages.

What is claimed is:

1. A container for food and beverage items, the container comprising:

a base;

a peripheral wall comprising a plurality of wall sections, the peripheral wall extending from around a periphery of the base;

a lid comprising a lid panel and a plurality of lid edges, and a plurality of lid flaps, wherein the plurality of lid edges includes first, second, third, and fourth lid edges, wherein the lid panel comprises a first lid-panel region, and a second lid-panel region, and a third lid-panel region, wherein the first lid-panel region is at least partially bound by the second lid edge and the second lid-panel region, wherein the third lid-panel region is at least partially bound by the fourth lid edge and the second lid-panel region, wherein the second lid-panel region is between the first and third lid-panel regions, wherein the first lid-panel region includes a first aperture-defining region that defines a first lid aperture that extends through the lid panel, wherein the second lid-panel region includes a second aperture-defining region that defines a second lid aperture that extends through the lid panel, and includes a third aperture-defining region that defines a third lid aperture that extends through the lid panel; and a handle having a grip region and first and second handle-end regions on opposing sides of the grip region, wherein the first handle-end region extends through the second lid aperture and the second handle-end region extends through the third lid aperture.

2. The container according to claim 1, wherein the lid further comprises a plurality of lid flaps including first, second, and third lid flaps, wherein the first lid flap is hingedly connected to the lid panel along the first lid edge, wherein the second lid flap is hingedly connected to the lid panel along the second lid edge, and wherein the third lid flap is hingedly connected, opposite the first lid flap, to the lid panel along the third lid edge.

3. The container according to claim 2, wherein the lid panel is hingedly connected, opposite the second lid flap, to one of the plurality of wall sections along the fourth lid edge.

4. The container according to claim 1 wherein each of the first and second handle-end regions includes a respective neck and head.

5. The container according to claim 4, wherein, for each of the first and second handle-end regions, the respective neck extends through the respective aperture, and the respective head is disposed on a side of the respective aperture opposite that of the grip region.

6. The container according to claim 1, wherein the lid further comprises a lid flap hingedly connected to the lid panel, wherein the container further comprises a fastener for allowing the lid flap to be selectively fastened to one of the plurality of wall sections.

7. The container according to claim 6, wherein the fastener comprises mating hook and loop parts, wherein one of the hook and loop parts is fixed to the lid flap and another of the hook and loop parts is fixed to the one of the plurality of wall sections.

8. The container according to claim 1, wherein the base, peripheral wall, and lid are formed from a single continuous sheet of fiberboard.

* * * * *